US005582399A

United States Patent [19]

Sugiura

[11] Patent Number: 5,582,399

[45] Date of Patent: Dec. 10, 1996

[54] SHEET FEEDING DEVICE HAVING SHEET EDGE SENSOR

[75] Inventor: Toshio Sugiura, Anjyo, Japan

[73] Assignee: Brother Kogyo Kabushiki Kaisha, Nagoya, Japan

[21] Appl. No.: 422,261

[22] Filed: Apr. 14, 1995

[30] Foreign Application Priority Data

Apr. 26, 1994 [JP] Japan ..... 6-088641

[51] Int. Cl.[6] ..... B65H 5/00

[52] U.S. Cl. ..... 271/10.11; 271/10.02; 271/119; 271/120; 271/121; 271/265.01

[58] Field of Search ..... 271/10.02, 10.09, 271/10.11, 110, 119, 120, 121, 265.01

[56] References Cited

U.S. PATENT DOCUMENTS

| | | | |
|---|---|---|---|
| 4,791,457 | 12/1988 | Shida | 271/119 |
| 5,029,839 | 7/1991 | Kajiwara et al. | 271/121 |
| 5,186,448 | 2/1993 | Ohsawa et al. | 271/10.09 |
| 5,273,267 | 12/1993 | Neugebayer | 271/121 |
| 5,316,285 | 5/1994 | Olson et al. | 271/121 |
| 5,318,287 | 6/1994 | Okayama | 271/10.09 |

*Primary Examiner*—H. Grant Skaggs
*Attorney, Agent, or Firm*—Oliff & Berridge

[57] ABSTRACT

A sheet feeding device for feeding a sheet stacked on a sheet cassette to an image forming portion of an image recording apparatus. The sheet feeding device includes a sheet supplying roller unit and a sheet feed roller positioned downstream thereof. The sheet supplying roller unit includes an intermediate small diameter portion and integral large diameter portions positioned to interpose the small diameter portion therebetween. Each large diameter portion has a contacting area in contact with the sheet, whereas the intermediate small diameter portion is spaced away from the sheet. A sheet edge detection arm is swingably provided and contactable with the sheet fed by the contacting area. The sheet edge detection arm is movable into a space defined between the small diameter portion and a confronting separation pad. If sheet is fed by the sheet supplying roller unit, the sheet edge detection arm is urged by the sheet and a posture of the arm is changed. The arm is abuttable to a lever member which is pivotally movable in accordance with the movement of the sheet edge detection arm. A photosensor is provided at a moving locus of the lever member. When the lever member moves across the photosensor, sheet edge detection signal is generated.

18 Claims, 3 Drawing Sheets

SHEET FEEDING DEVICE HAVING SHEET EDGE SENSOR

BACKGROUND OF THE INVENTION

The present invention relates to a sheet feeding device for successively feeding each one sheet of a sheet stack in a sheet tray toward an image recording portion.

A conventional sheet feeding device includes a sheet supplying roller for successively taking out each one of the sheets stacked in a sheet supply tray. The device also includes a sheet feed roller for feeding the sheet supplied by the sheet supplying roller to an image recording portion. During feeding of the sheet toward the image recording portion, a leading edge of the sheet is detected to determine whether or not the leading edge passes through a predetermined spot, or a trailing edge of the sheet is detected to determine whether or not the trailing edge exits the sheet supply tray. By such a detection, operation timing of the image recording portion is controlled, or sheet feed timing for the subsequent sheet is controlled. To this effect, a sensor is provided at a position upstream of the sheet feed roller to detect the leading edge or trailing edge of the sheet.

However, in the conventional sheet feeding device, control to the subsequent operation is initiated after the leading or trailing edge of the sheet is fed to the position immediately upstream of the sheet feed roller. Therefore, the operation start timing may be retarded. Further, the interval of sheet feedings may be prolonged. Consequently, prolonged time period is required for entire image recording operation for successively recording a plurality of sheets.

SUMMARY OF THE INVENTION

To avoid this problem, the sheet edge sensor should be positioned remotely upstream of the image recording portion. However, in such a remote portion in the sheet feed passage, the sheet floating may occur, which degrades detection by the sensor.

Particularly, one conventional printer positively provides a sheet slack by abutting the leading edge of the sheet fed by the sheet supply roller against the sheet feed roller in order to correct diagonal sheet feeding. In such a type, sheet detection at the sheet feeding passage may become difficult.

It is therefore, an object of the present invention to provide an improved sheet feeding device capable of detecting the sheet fed by the sheet supply roller at an early timing so as to reduce entire period for image recordation without sheet floating at the sheet feed passage.

This and other objects of the present invention will be attained by a sheet feeding device for feeding each sheet of a sheet stack on a sheet cassette to an image forming portion of an image recording apparatus, the feeding device including a sheet supplying roller unit, a sheet feed roller, and sheet edge detection means. The sheet supplying roller unit is provided rotatable about a rotation axis for supplying the each sheet of the sheet stack from the sheet cassette. The sheet supplying roller unit has a contacting area in contact with the sheet having a width and an axial length of the contacting area is smaller than the width of the sheet. The sheet feed roller is positioned downstream of the sheet supplying roller unit for feeding the sheet from the sheet supplying roller unit to the image forming portion. A sheet passage is defined between the sheet supplying roller unit and the sheet feed roller. The sheet edge detection means is adapted for detecting an edge of the sheet fed in the sheet passage and generating a sheet edge detection signal. The sheet edge detection means includes a sheet edge detection member provided movably in a direction across the sheet feed passage and contactable with the sheet. The sheet edge detection member is positioned offset from the contacting area but positioned in the vicinity of the contacting area and is movable to a position substantially on the rotation axis.

DETAILED DESCRIPTION OF THE PREFERRED EMBODIMENTS

Figure 1:
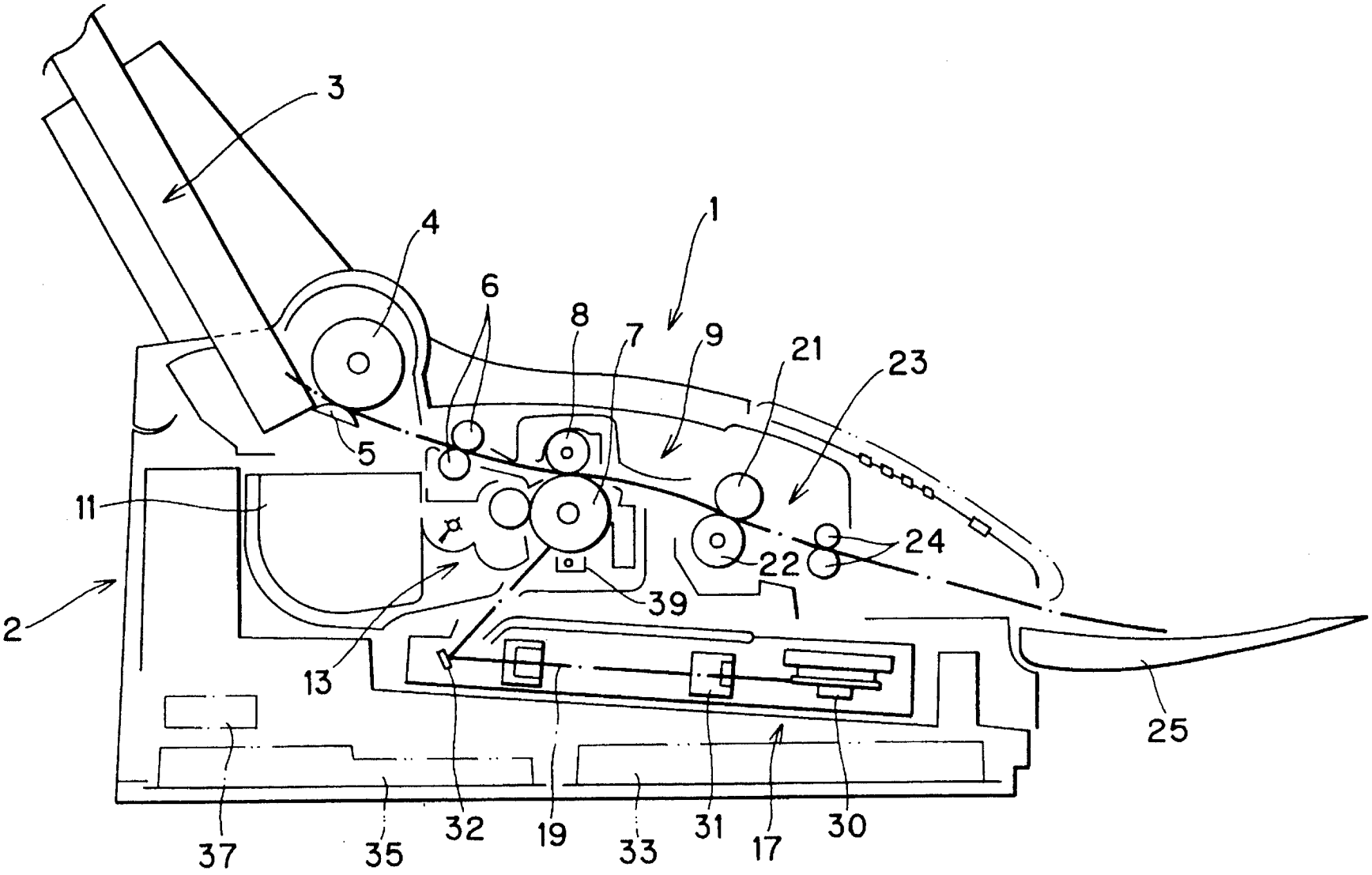
FIG. 1 is a schematic cross-sectional view showing a laser printer incorporating therein a sheet feeding device according to one embodiment of the present invention.

A sheet feeding device according to one embodiment of the present invention will be described with reference to FIGS. 1 through 3. FIG. 1 shows a laser printer 1 incorporating therein the sheet feeding device. The laser printer 1 includes a frame body 2 whose rear upper portion is detachably provided with a sheet cassette 3 serving as a sheet supply tray. At a cassette installing portion, a sheet supply roller unit 4 and a holder 5 in pressure contact with the sheet supply roller unit 4 are provided for separating an uppermost sheet P from the sheet stack in the cassette 3. Further, a pair of sheet feed rollers 6 are provided downstream of the sheet supply roller unit 4 for feeding the uppermost sheet to an image recording portion such as a developing unit 9.

The developing unit 9 includes a photosensitive drum 7, an image transfer roller 8 in nipping relation to the photosensitive drum 7, a charger 39, a toner cartridge 11 for accumulating therein toners, and a developing portion 13 to which toners are supplied from the toner cartridge 11. A scanner unit 17 is provided for emitting laser beam 19 so as to provide an image on the sheet P. Further, a control boards 33 and 35 and a power unit 37 are provided on a bottom wall of the frame body 2.

The scanner unit 17 is disposed below the developing unit 9 and includes a laser beam generating portion 30, a lens 31 and a reflection mirror 32. An external equipment such as a computer (not shown) transmits image data to the control board, so that the scanner unit 17 emits laser beam 19 in accordance with the image data. Thus, an electrostatic latent image is formed in accordance with the image data on the surface of the photosensitive drum 7 provisionally charged by the charger 39*a*. The developing portion 13 visualizes the latent image by the magnetized toners, and then the toner image is transferred onto the sheet P nipped between the photosensitive drum 7 and the image transfer roller 8.

An image fixing unit 23 including a heat roller 21 and a pressure roller 22 is provided downstream of the developing unit 9 for thermally fixing a toner image on the sheet P. A pair of discharge rollers 24 are provided downstream of the fixing unit 23 for discharging the image carried sheet onto a discharge tray 25.

Figure 2:
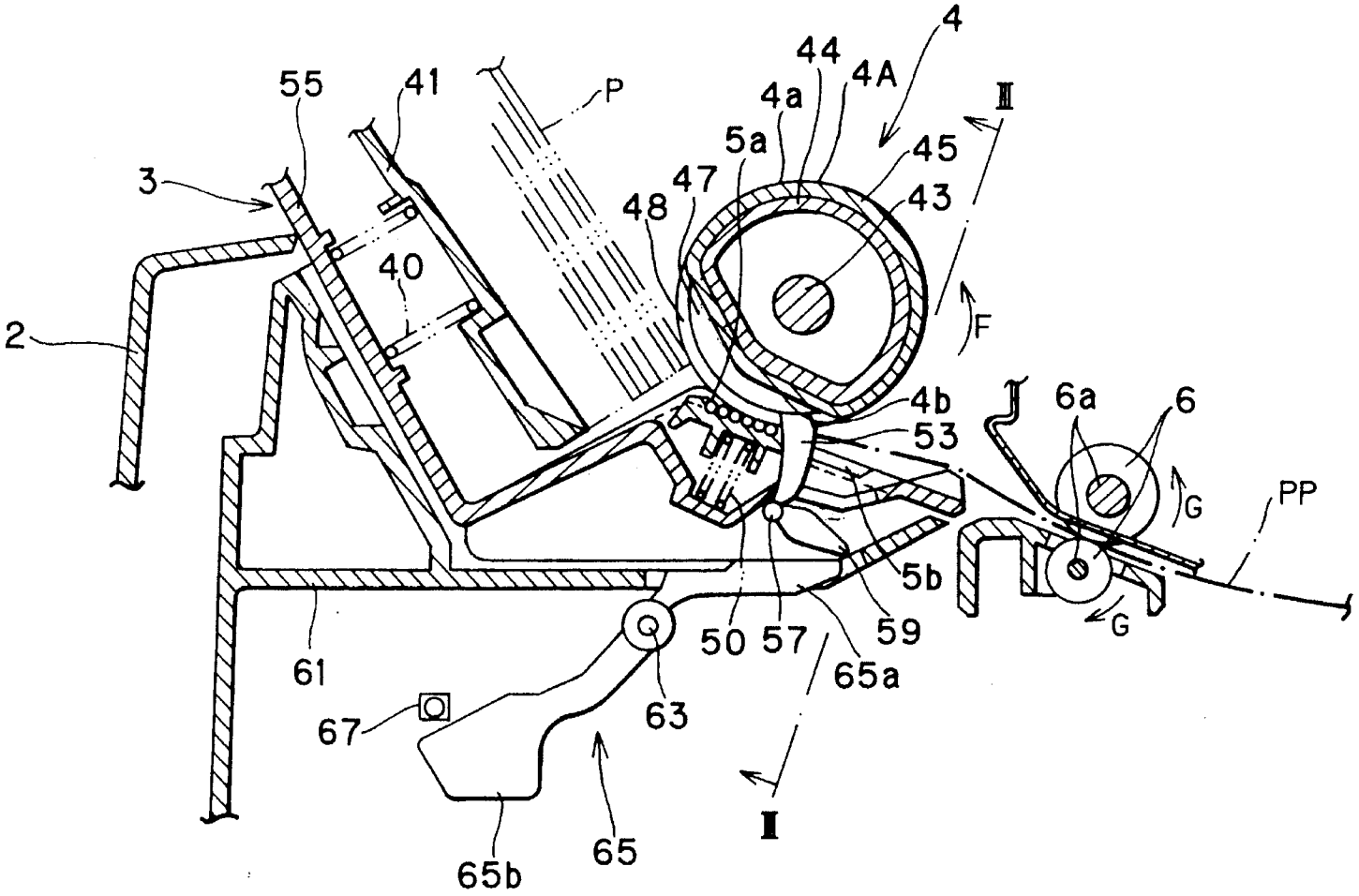
FIG. 2 is a vertical cross-sectional view showing a sheet supply roller unit and ambient arrangement of the laser printer according to the embodiment, and taken along the line II—II—II—II of FIG. 3.
Figure 3:
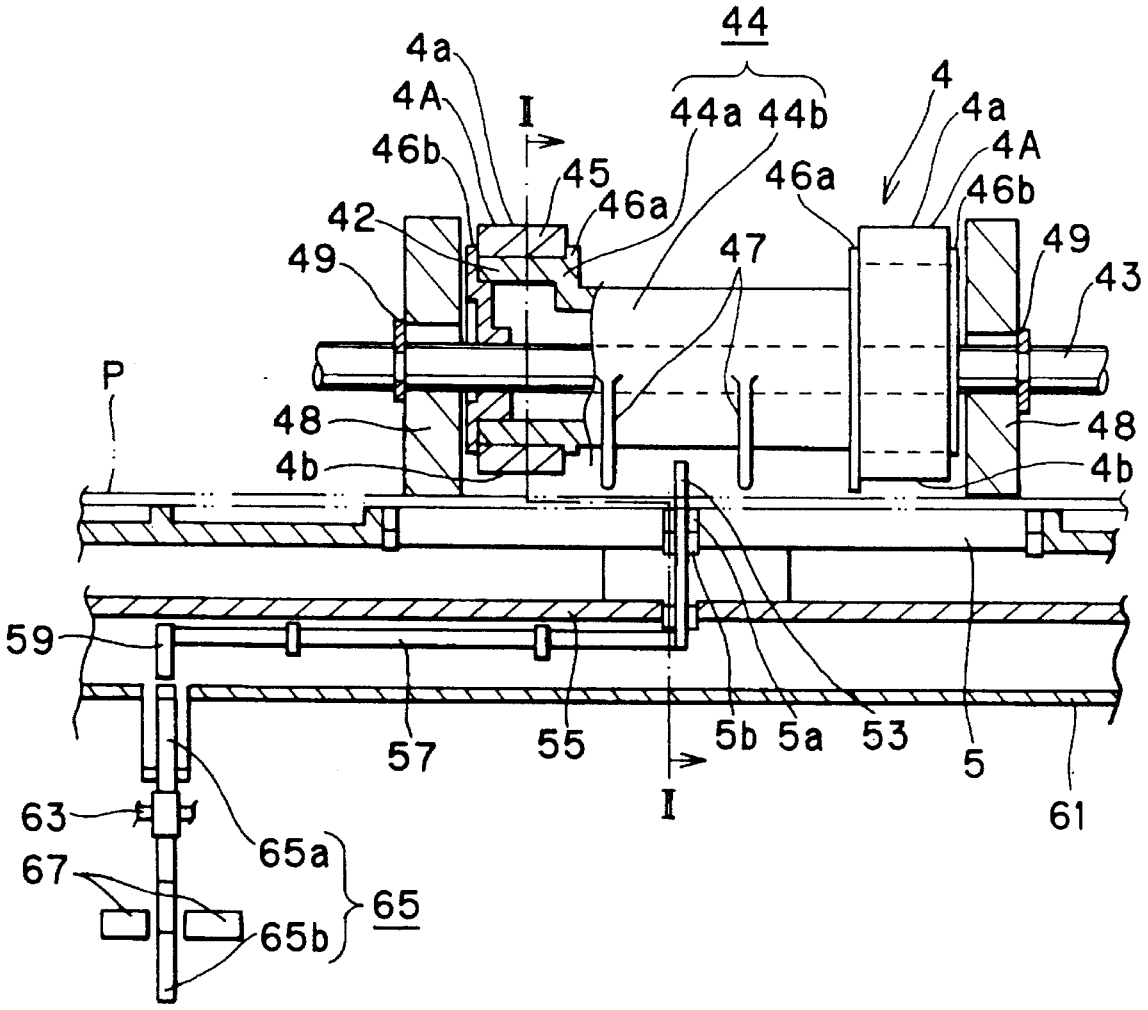
FIG. 3 is a transverse cross-sectional view taken along the line III—III of FIG. 2 showing the sheet supply roller unit and ambient arrangement of the laser printer according to the embodiment.

As best shown in FIG. 2, a sheet support plate 41 is disposed in the sheet cassette 3 and is urged upwardly by a coil spring 40, so that the sheet support plate 41 is movable toward a position immediately below the sheet supply roller unit 4. A stack of sheets P is mounted on the sheet support plate 41. An upper surface of the lower edge portion of the uppermost sheet P of the sheet stack is in contact with the peripheral surface of the sheet supply roller unit 4.

The sheet supply roller unit 4 includes a sleeve 44 formed of a synthetic resin. The sleeve 44 is provided integrally with a drive shaft 43, so that the sleeve 44 is rotatable together with the rotation of the drive shaft 43. The drive shaft 43 is intermittently rotatable by a drive motor (not shown) through a power transmission gear train. The sleeve 44 has a small diameter portion **44*b* and large diameter portions 44*a*, 44*a* at both axial ends of the sleeve 44, and rollers 42 are provided on the large diameter portions 44*a*, 44*a* by fitting an annular endless linings 4A, 4A thereover. The linings 4A, 4**A are formed of a material having high friction coefficient such as rubber.

Thus, the rollers 42, 42 are spaced away from each other by the axial length of the small diameter portion **44*b*. Each roller 42 includes an arcuate contacting portion 4*a* contactable with the sheet P, and a chordal portion or non-contacting portion 4*b* out of contact with the sheet P, so that the roller 42 has a large character D or semicircular shape in cross-section. A pair of flanges 46*a*, 46*b* extend radially outwardly from the axial end portions of each large diameter portion 44*a*, 44*a* in order to prevent the annular linings 42, 42 from moving in axial direction of the large diameter portions 44*a***.

A plurality of ribs 47 extend radially outwardly from the small diameter portion **44*b*. These ribs are spaced away from each other in the axial direction of the small diameter portion 44*b*, and a radius of each rib 47 is smaller than a radius of the contacting portion 4*a*, and is greater than a maximum radius of the non-contacting portion 4*b*. Angular position of the plurality of ribs is identical with the non-contacting portion 4*b* so as to avoid sheet slack. That is, the ribs 47 project from the small diameter portion 44*b* at the angular position superposed with the non contacting area 4*b* of the rollers 42, 42**.

A pair of sheet supply collars 48, 48 formed of a synthetic resin are loosely mounted over the drive shaft 43 and are disposed to interpose the sheet supply roller 44 therebetween. Stop rings 49, 49 are fitted to the drive shaft 43 to prevent the collars 48 from moving in the axial direction of the drive shaft 43, whereas these collars 48 are freely rotatable in the sheet feeding direction. A radius of the collar 48 is equal to the radius of the contacting portion **4*a*. However, inner bore diameter of the collar 48 is greater than the outer diameter of the drive shaft 43. With this arrangement, the collars 48 do not affect the contacting relationship between the contacting portion 4*a* and the sheet P, while own weight of the collars 48** can always be applied to the surface of the sheet P.

The upper surface of the holder 5 is affixed with a separation pad **5*a* formed of high friction coefficient material. The holder 5 is positioned adjacent the lower end of the sheet cassette 3 and is biased toward the sheet supply roller unit 4 by a coil spring 50. The separation pad 5a has a length corresponding to or greater than a distance between distal ends of the pair of collars 48 and 48. The above described collars 48 are adapted to prevent the separation pad 5*a* from being lifted to be brought into contact with the non-contacting portion 4*b* of the sheet supply roller unit 4, when the latter faces the pad 5*a***.

The holder 5 is formed with an elongated cut-out **5*b* a portion in confrontation with a particular portion of the small diameter portion 44*b*, the particular portion being an area defined between the neighboring ribs 47, 47. The cut-out 5*b* starts from the downstream edge of the holder 5** and extends toward the upstream edge thereof.

A sheet cassette 3 has a cassette frame 55, and a rotation shaft 57 is rotatably supported to the lower surface of the cassette frame 55. One end of the rotation shaft 57 is fixed with a sheet edge detection arm 53 extending through the elongated cut-out **5*b* and projecting into a sheet feed passage, so that the sheet edge detection arm 53 is pivotally movable about an axis of the rotation shaft 57 when the sheet P fed is brought into abutment with the sheet edge detection arm 53. A spring (not shown) is connected to the sheet edge detection arm 53 so as to orient the latter toward the small diameter portion 44*b*. The rotation shaft 57 has another end fixed with an operation piece 59. In accordance with the pivotal movement of the sheet edge detection arm 53, the operation piece 59** is pivotally movable.

On the other hand, a frame body 61 of the laser printer 1 supports a pivot shaft 63, and a swingable lever 65 is rotatably supported to the pivot shaft 63. The swingable lever 65 includes a first lever portion **65*a* abuttable against the operation piece 59, and a second lever portion 65*b*. A detection member such as a photosensor 67 is provided to the frame body 61. The second lever portion 65*b* is provided at a position passable through the photosensor 67 so as to shut off an optical passage when the lever 65** is pivotally moved.

The contacting areas **4*a*, 4*a* have a total axial length smaller than the width of the sheet P, so that the sheet edge detection arm 53 can be positioned offset from the contacting areas 4*a*, 4*a* but can be positioned in confrontation with the sheet P (It goes without saying that if the sheet edge detection arm 53 is positioned in confrontation with the contacting area 4*a*, the arm 53 is always positioned at its sheet detecting position, and therefore, sheet detecting operation cannot be made). Further, the sheet edge detection arm 53 is positioned in the vicinity of the contacting portions 4*a*, 4*a* and on or around an axis of the contacting areas 4*a*, 4*a*, so that the sheet detection can surely be made by the sheet edge detection arm 53 without influence of the sheet floating. That is, the sheet floating amount is decreased at a position toward the contacting areas 4*a*, 4*a*. Therefore, accurate sheet detection can be made if the sheet edge detection arm 53 is positioned close to the contacting areas 4*a*, 4*a***.

As best shown in FIG. 2, if the sheet P is not introduced between the sheet supply roller unit 4 and the holder 5, the sheet edge detection arm 53 projects out of the cut-out **5*b* and directs toward the small diameter portion 44*b*. In this instance, the operation piece 59 does not abut the first lever portion 65*a* of the swingable lever 65, and as a result, the optical passage from the photosensor 67 is not shut off by the second lever 65*b*. On the other hand, if the sheet P is introduced between the sheet supply roller unit 4 and the holder 5, the sheet edge detection arm 53 is urged by the sheet P so that the operation piece 59 is pivotally moved in a clockwise direction in FIG. 2. Therefore, the first lever 65*a* is pivotally moved in the clockwise direction to pivot the second lever 65*b* in the direction. As a result, the second lever 65*b* shuts off the optical passage. In accordance with a signal from the photosensor 67, existence of the sheet at the position between the sheet supply roller unit 4 and the holder 5** can be determined.

In the sheet feed stand-by phase, the non-contacting portion **4*b* of the sheet supply roller unit 4 is in confrontation with the holder 5, and the separation pad 5***a* pushes the collars 48 by the biasing force of the spring 50. Upon input of print command into the laser printer 1, the control portion of the control boards 33, 35 outputs sheet feed signal. In response to the sheet feed signal, the drive motor (not shown) is energized to rotate the drive shaft 43 by 360 degrees, so that the sheet feed roller 4 is rotated in the sheet feed direction (in a direction F in FIG. 2).

By this rotation, the uppermost sheet P in the sheet cassette 3 is brought into contact with the contact portion 4*a* of the sheet supply roller unit 4, and the uppermost sheet P is solely nipped between the contact portion 4*a* and the separation pad 5*a*. The thus nipped sheet P is fed toward the pair of feed rollers 6. During this feeding, the sheet feed collars 48 loosely mounted on the drive shaft 43 press the sheet P toward the separation pad 5*a* because of their own weight Further, the sheet edge detection arm 53 is pushed by the leading edge of the sheet P and is pivoted toward the sheet feeding direction. As a result, the second lever 65*b* of the swingable lever 65 shuts off the optical path of the photosensor 67. The signal indicative of the shutting-off is transmitted from the photosensor 67 to the control portion of the control boards 33, 35.

In accordance with the signal, the control portion transmits a signal to a driver of the sheet feed rollers 6 so as to stop or reversely rotate the sheet feed rollers 6. Further, in response to the signal, a signal for applying high voltage to the image recording portion is output.

Since the pair of feed rollers are stopped or reversely rotated (in the direction opposite G in FIG. 2) in response to the sheet detection signal, the leading edge of the sheet P cannot pass through the feed rollers 6. Further, since the arcuate length of the contacting portion 4*a* of the sheet feed roller 4 is greater than a sheet feed path length PP between the nipping point of the sheet supply roller unit 4 and the nipping point of the sheet feed rollers 6. Therefore, a slack is provided at the leading edge portion of the sheet P. With the sheet slack, leading edgeline of the sheet can be oriented in parallel with the rotation shafts 6a of the sheet feed rollers 6 for avoiding a diagonal entry of the sheet into the sheet feed rollers 6.

After 360 degrees rotation of the sheet supply roller unit 4, the non-contacting portion 4*b* is again in confrontation with the separation pad 5*a*. During non-rotating phase of the sheet supply roller unit 4, the collars 48 press onto the sheet P toward the separation pad 5*a* because of their own weight. In this case, the ribs 47 are also stopped where the ribs are positioned close to the sheet P. Therefore, amount of the sheet slack at a position around the sheet edge detection arm 53 is small, since the sheet is urged by the ribs 47. In other words, even though the sheet slack is positively created for alignment of the leading edge of the sheet in a direction parallel with the shaft 6*a*, sheet slack amount at a position around the sheet edge detection arm 53 can be reduced by the ribs 47. The sheet supplying roller has the contacting area 4*a* contactable with the sheet for positive sheet supplying to the sheet feed roller and the non-contacting area 4*b* out of contact with the sheet. The non-contacting area 4*b* serves to reduce a load to be applied to the sheet after the leading end of the sheet reaches and is nipped by the sheet feed roller. However, if the sheet is faced with the non-contacting area 4*b*, the sheet floating may occur unless the ribs 47 are provided.

Then, the pair of feed rollers 6 are rotated in the sheet feeding direction G by the drive motor, so that the sheet P is fed toward the developing unit 9. In this case, since the leading edge of the sheet P is directed in parallel with the rotation axis 6*a*, formation of a diagonal image to the sheet P can be obviated. When the trailing edge of the sheet P passes is fed past the sheet supply roller unit 4, the sheet edge detection arm 53 is pivotted toward the small diameter portion 44*b*, and therefore, the second lever 65*b* is displaced from the optical path. Thus, the photosensor 67 transmits a signal indicative of passage of the trailing edge of the sheet through the sheet supply roller unit 4. In response to this signal, determination is made in the control portion in the control board 33, 35 as to whether or not successive print data exist. If determination falls Yes, the sheet supply signal is again output from the control portion so as to again rotate the sheet supply roller unit 4. If no print data is stored, the control portion transmits signal to the image recording portion for their post printing operation.

In the embodiment described above, the sheet edge detection arm 53 is located at a position in confrontation with the small diameter portion 44*b* for detecting the leading and trailing edges of the sheet P. Therefore, sheet edge detection can be performed at an early timing during one sheet feed cycle from the sheet cassette to the image recording portion. Because of the prompt detection, standby operation of the pair of sheet feed rollers 6 and image recording portion can be performed within a sufficient time period, to thereby perform stabilized image recording operation.

Further, the sheet edge detection arm 53 is positioned close to the contacting area 4*a* and on or near the axis of the contact area 4*a*. Therefore, the detection of the sheet can be performed at a position where floating of the sheet is restrained or reduced.

Furthermore, in the illustrated embodiment, subsequent sheet feeding operation can be performed immediately after the detection of the trailing edge of the preceding sheet P. Therefore, distance between the trailing edge of the preceding sheet and the leading edge of the subsequent sheet can be reduced to thereby reduce dead time between successive image recording operation. For example, if the sheet feed roller 4 can be promptly driven upon detection of the trailing edge of the preceding sheet by the sheet edge detection arm 53, the leading edge of the subsequent sheet can be fed to the detection arm 53 when the trailing edge of the precedent sheet P passes through the pair of feed rollers 6. With this arrangement, distance between the two sheets becomes extremely small. As a result, the developing unit 9 can continue image recording operation without apparent dead time. Consequently, printing to the large numbers of sheets can be made within reduced period.

Furthermore, in the laser printer 1, the sheet cassette 3 and the sheet feed roller unit 4 are integrally detachable from the main frame 2 of the printer 1 for compact installation in the non-use period of the printer. If the photosensor 67 is provided integrally to the sheet cassette 3, connectors must be used detachably connectable between the cassette 3 side and the main frame 2 side for transmitting signals from the photosensor (cassette side) to the control boards 33, 35 (main frame side). The use of the connectors may render the overall device complicated and costly. However, in the illustrated embodiment, the photosensor 67 is provided onto the main frame 2 of the printer 1, and the displacement of the sheet detection arm 53 is detected by the photosensor 67 by way of the operation piece 59 and the swingable lever 65. Therefore, connectors are not required. Moreover, by the employment of the swingable lever 65, the degree of freedom with respect to the installing position of the photosensor 67 can be improved.

Furthermore, in the illustrated embodiment, sheet slacking amount at a position around the sheet edge detection arm 53 can be greatly reduced because of the provision of the pair of ribs 47 and the pair of collars 48, these being positioned to interpose the detection arm 53 therebetween to press the sheet. As a result, precise detection to the leading edge and trailing edge can be made. In other words, sheet floating at the sheet edge detecting portion does not occur in the illustrated embodiment. Therefore, detection error or detection impossibility does not occur, and the trailing edge of the sheet can be precisely detected. Accordingly, immediately after the detection of the trailing edge, sheet supply signal can be output to reduce entire time period for image recordation to the plurality of sheets.

Furthermore, in the illustrated embodiment, the moving area of the sheet edge detection arm 53 is positioned at downstream half of the separation pad 5*a*. In other words, the slot 5*b* extends from the downstream edge of the separation pad 5*a* to the intermediate portion thereof. Therefore, the sheet edge detection arm 53 does not affect the sheet separating operation of the separation pad 5*a* when detecting the sheet edge. Consequently, every one sheet P can be supplied from the cassette 3 to the sheet feed rollers 6 without dual or superposing sheet feed.

While the invention has been described in detail and with reference to specific embodiments thereof, it would be apparent to those skilled in the art that various changes and modifications may be made therein without departing from the spirit and scope of the invention.

For example, only the arcuate portion 4*a* of the roller 4A can be formed of high friction coefficient material. Further, the swingable arm 65 can be dispensed with and, it is possible to directly detect the displacement of the operation piece 59 by a photosensor fixed to the frame 61, instead of the relationship between the photosensor 67 and the second link 65*b*. Still however, the employment of the swingable arm 65 can enhance degree of freedom with respect to the installing position of the photosensor 67 as described above.

Further, if a laser printer is of a type wherein a sheet cassette is fixedly secured to the main frame of the laser printer, a photosensor can be installed on the frame 55 of the sheet cassette for detecting the displacement of the sheet edge detection arm 53. Further, if a laser printer is of a type wherein a sheet cassette is provided detachably from the main frame of the sheet cassette like the above described embodiment, the photosensor can be installed onto the frame 55 of the sheet cassette 3. In both cases, connectors are required for transmitting signals from the photosensor (cassette side) to the control boards (printer frame side). Even though resultant structure becomes intricate due to the provision of the connectors, edge of the sheet P can be promptly detected similar to the above described embodiment to reduce image recording period. Instead of the photosensor 67, another sensor such as a Hall device is available.

Furthermore, in the above described embodiment, the subsequent sheet feeding command is output in response to the detection of the trailing edge of the precedent sheet. However, it is possible to output the command in accordance with the detection of the leading edge of the precedent sheet. In the latter case, sheet size setting switch is provided, and a predetermined time period is determined in accordance with the sheet size, the predetermined time period starting from the leading edge detection and ending at which the trailing edge of the sheet is deemed to have been passed through the sheet supply roller unit 4. Alternatively, predetermined rotation numbers of the pair of feed rollers 6 is set in accordance with the sheet size. The predetermined rotation numbers correspond to the feed length where the trailing edge of the sheet is deemed to have been passed through the sheet supply roller after detection of the leading edge thereof. After elapse of the predetermined period or after the predetermined rotation of the sheet feed rollers, sheet supply command is output to the sheet supply roller unit 4. Still however, slippage may occur between the sheet supply roller unit 4 and the sheet P or between the sheet feed roller 6 and the sheet P. Therefore, the trailing edge of the sheet may not pass through the sheet supply roller after the predetermined time period or after rotation of the sheet feed rollers by the predetermined rotation numbers. In such a case, sheet supply command for the subsequent sheet may be output at an erroneous timing. Therefore, the illustrated embodiment is advantageous in that the sheet supply command is output at an accurate timing because this command is output in response to the detection of the trailing edge of the sheet.

What is claimed is:

1. A sheet feeding device for feeding each sheet of a sheet stack on a sheet cassette to an image forming portion of an image recording apparatus, the feeding device comprising:

a sheet supplying roller unit rotatable about a rotation axis for supplying the each sheet of the sheet stack from the sheet cassette, the sheet supplying roller unit having a diameter and a contacting area in contact with the sheet, the sheet having a width, an axial length of the contacting area being smaller than the width of the sheet;

a sheet feed roller positioned downstream of the sheet supplying roller unit for feeding the sheet from the sheet supplying roller unit to the image forming portion, a sheet passage being defined between the sheet supplying roller unit and the sheet feed roller; and sheet edge detection means for detecting an edge of the sheet fed in the sheet passage and generating a sheet edge detection signal, the sheet edge detection means comprising a sheet edge detection member that is movable in a direction across the sheet feed passage and contactable with the sheet, the sheet edge detection member being positioned offset from the contacting area and adjacent a separation member and projecting into the diameter of said sheet supplying roller unit.

2. The sheet feeding device as claimed in claim 1, wherein the sheet supplying roller unit comprises:

at least two rollers eccentrically rotatable about a common axis and being spaced apart from one another to define an intermediate space therebetween, the at least two rollers having an outer peripheral portion provided with the contacting area, the sheet edge detection member being movable toward and away from the intermediate space.

3. The sheet feeding device as claimed in claim 2, wherein the sheet supplying roller unit further comprises at least one rib projecting into the space and having a radius for restraining floating of the sheet at a portion in confrontation with the space, the at least two rollers having a radius greater than the radius of the at least one rib.

4. The sheet feeding device as claimed in claim 2, wherein the sheet supplying roller unit further comprises:

a sleeve member having pair of large diameter portions and an intermediate small diameter portion interposed therebetween, rubber linings being disposed over the large diameter portions to provide the contacting area; and said separation member disposed in a confronting relation to the sleeve member, the sheet being conveyable through and between the contacting area and said separation member.

5. The sheet feeding device as claimed in claim 4, wherein the image recording apparatus has a frame body to which the sheet cassette is detachably installable, and wherein the sheet edge detection means further comprises a sheet detecting portion for generating the sheet edge detection signal in response to a movement of the sheet edge detection member, the sheet detecting portion being disposed at the frame body.

6. The sheet feeding device as claimed in claim 5, wherein the sheet detecting portion comprises:

a pivot shaft rotatably supported by the frame body;

a first lever portion rotatably supported to the pivot shaft and abuttable against the sheet edge detection member;

a second lever portion rotatably supported to the pivot shaft and movable in accordance with the movement of the first lever portion; and a photosensor disposed to the frame body for transmitting the sheet edge detection signal, the second lever having a movable locus across the photosensor.

7. The sheet feeding device as claimed in claim 6, wherein the sheet supplying roller unit further comprises:

a drive shaft, the sleeve being fixedly disposed over the drive shaft;

a pair of collars loosely disposed over the drive shaft and in contact with the separation member, each of the pair of collars being positioned outside of the large diameter portions, the contacting area having a radius equal to a radius of the collars.

8. The sheet feeding device as claimed in claim 4, wherein the separation member extends along the sheet feed passage and includes a downstream half portion extending toward a downstream side of the sheet feed passage, the sheet edge detecting member having a moving locus passing through the downstream half portion of the separation member.

9. The sheet feeding device as claimed in claim 4, wherein the sheet supplying roller unit further comprises at least one rib projecting into the space from the small diameter portion and having a radius for restraining floating of the sheet at a portion in confrontation with the space, the at least two rollers having a radius greater than the radius of the at least one rib.

10. The sheet feeding device as claimed in claim 9, wherein the large diameter portion includes a semicircular portion and a chordal portion, the semicircular portion serving as the contacting area.

11. The sheet feeding device as claimed in claim 10, wherein the at least one rib projects from the small diameter portion at an angular position corresponding to a position of the chordal portion.

12. The sheet feeding device as claimed in claim 1, wherein the image recording apparatus has a frame body to which the sheet cassette is detachably installable, and wherein the sheet edge detection means further comprises a sheet detecting portion for generating the sheet edge detection signal in response to a movement of the sheet edge detection member, the sheet detecting portion being disposed at the frame body.

13. The sheet feeding device as claimed in claim 12, wherein the sheet detecting portion comprises:

a pivot shaft rotatably supported by the frame body;

a first lever portion rotatably supported to the pivot shaft and abuttable against the sheet edge detection member;

a second lever portion rotatably supported to the pivot shaft and movable in accordance with the movement of the first lever portion; and a photosensor disposed to the frame body for transmitting the sheet edge detection signal, the second lever having a movable locus across the photosensor.

14. The sheet feeding device as claimed in claim 1, wherein the edge detection member has a contactable range with respect to the sheet, the contactable range being positioned downstream of the contacting area and within the diameter of the sheet supplying roller unit.

15. A sheet feeding device for feeding each sheet of a sheet stack on a sheet cassette to an image forming portion of an image recording apparatus, the feeding device comprising:

a sheet supplying roller unit rotatable about a rotation axis for supplying the each sheet of the sheet stack from the sheet cassette, the sheet supplying roller unit having a diameter and a contacting area in contact with the sheet, the sheet having a width, an axial length of the contacting area being smaller than the width of the sheet;

a sheet feed roller positioned downstream of the sheet supplying roller unit for feeding the sheet from the sheet supplying roller unit to the image forming portion, a sheet passage being defined between the sheet supplying roller unit and the sheet feed roller; and sheet edge detection means for detecting an edge of the sheet fed in the sheet passage and generating a sheet edge detection signal, the sheet edge detection means comprising a sheet edge detection member that is movable in a direction across the sheet feed passage and contactable with the sheet, the sheet edge detection member being positioned offset from the contacting area and in a manner such that a sheet detection signal can be generated before the sheet passes the diameter of said sheet supplying roller unit.

16. The sheet feeding device as claimed in claim 15, wherein the edge detection member has a contactable range with respect to the sheet, the contactable range being positioned downstream of the contacting area.

17. The sheet feeding device as claimed in claim 15, wherein the sheet supplying roller unit comprises:

at least two rollers eccentrically rotatable about a common axis and spaced apart from one another to define an intermediate space therebetween, the at least two rollers having an outer peripheral portion provided with the contacting area, the sheet edge detection member being movable toward and away from the intermediate space.

18. The sheet feeding device as claimed in claim 15, wherein the image recording apparatus has a frame body to which the sheet cassette is detachably installable, and wherein the sheet edge detection means further comprises a sheet detecting portion for generating the sheet edge detection signal in response to a movement of the sheet edge detection member, the sheet detecting portion being disposed at the frame body.

* * * * *